United States Patent [19]

Nowlan

[11] Patent Number: 4,971,865

[45] Date of Patent: Nov. 20, 1990

[54] ADJUSTABLE ANTLER HANGER BRACKET

[76] Inventor: Philip R. Nowlan, Box 86, Bouctouche, New Brunswick, Canada, E0A 1G0

[21] Appl. No.: 167,909

[22] Filed: Mar. 11, 1988

[30] Foreign Application Priority Data

Apr. 10, 1987 [CA] Canada ..... 534370

[51] Int. Cl.[5] ..... B44C 5/02

[52] U.S. Cl. ..... 428/542.4; 248/295.1; 428/16; 434/296

[58] Field of Search ..... 248/295.1; 434/295, 434/296, 297; 428/16, 542.4

[56] References Cited

U.S. PATENT DOCUMENTS

| | | | |
|---|---|---|---|
| 2,003,896 | 6/1935 | Menger | 434/296 |
| 4,464,440 | 8/1984 | Dotzman | 434/296 X |
| 4,717,626 | 1/1988 | Badeer | 434/296 X |

*Primary Examiner*—Ramon O. Ramirez

[57] ABSTRACT

It is bracket on which the top of an adult male deer's skull with antlers attached and cut approximately through the upper third of the eye socket to approximately 1 ¼ inch thick in the back of the skull, can be fastened on top of an adjustable base plate which can be moved forward so that the back of the antlers will not touch wall. It can accommodate most any size set of deer antlers. With the top of the adult deer's skull fastened to the base plate as recommended, the antlers will be in their most natural position just as if the deer was standing with his head upright and staring straight out in front of him, thus showing all the beauty and symmetry and different caracteristics of the deer's rack. The slight 10° degree downward angle of the base plate to the back plate is just enough that the top of the skull from the back to the front is horizontal or 90° degree to the back plate and the wall it is hung upon, the same angle as if the deer was standing with his head up and starting straight out in its most natural position for a deer that is elert, thus showing all the beauty and symmetry and caracteristics of the antler rack. This antler hanger bracket can be made of any suitable material, preferably ⅛ inch or 3/16 inch aluminum for different weight of antler racks.

2 Claims, 4 Drawing Sheets

ADJUSTABLE ANTLER HANGER BRACKET

The invention relates to an Adjustable Bracket used to display deer antlers in the same natural position as if the deer was standing with his head up and staring straight out in front of him. The Adjustable Bracket consist of a Back Wall Plate and a Base Plate which is at 100° downward angle to the Back Wall Plate and a Double Adjustable Plate which is the same size and shape as the Base Plate. The Double Adjustable Plate is fasten to the Base Plate with two bolts passed through holes and slots provided in these two. When the top of the skull with antlers intacted of an adult male deer is cut through the upper third of the eye socket to 1¼" thick in the back of the skull and fasten with two other bolts, with the cut side resting on the top of the Double Adjustable Plate that can be slipped forward so that the back of the antlers do not touch the wall, the 100° degree downward angle of the Double Base Plates to the Back Wall Plate is just enough that the top of the skull from the back to the front, which is directly in line with the front of where the base of the two antlers have grown out of the skull is now horizontal or 90° degree to the Back Wall Plate and the wall it is hung upon.

Conventional and Traditional methods of hanging deer antlers are disclosed in U.S. Pat. Nos. 2,003,896, 4,717,626 and 4,464,440. The first two of these prior art patents disclose that these two have cut-off most of the skull bone except a small bridge between the antlers. Observation of FIGS. 1 and 2 sheet 1 of my invention which were drawn from actual photos will show, that with only a small bridge of bone left between the antlers and fasten with it's flat surface almost perpendicular to the back or wall surface the mount will be hung upon, one can observe by looking at FIG. 2 sheet 1 that if this was done the main beams of the antler rack would be pointing down in a position not really showing the antler rack in it's most natural position. U.S. Pat. No. 4,464,440 requires that the two antlers be seperated completely from one another eliminating the bone structure of the skull completely. The "Boone and Crockett Club" which is an organization that keeps records of most big deer antler racks in both U.S.A. and Canada will not register nor score any deer rack which the antlers are not intact with the skull bone structure.

With my Adjustable Antler Hanger Bracket the defeciencies that I have mentioned concerning these three patents are overcome because the emphasis is on hanging the top of the skull of the adult male deer intact and at the same angle as if the deer was alert with his head up and staring straight out in front of him, regardless of the angle of the antlers, this way the antlers will be displayed as they really would have been on the deer's head in his most alert natural position. The top of the skull bone can be painted a shade of brown to simulate the color of the deer's scalp or it can be covered with most any suitable material. For a real professional looking job the actual top of the scalp of the deer itself can be used to cover the skull bone structure or even the scalp from another adult male deer. Also with the top of the skull left intact, if the owner of the mount decides to have the antlers mounted on a manikin with a fresh cape, he only needs to remove the two bolts that hold the top of the skull to the Double Adjustable Plate and the Taxidermist has all that he needs of the skull in order to remount the complete deer head.

Other objects and features of the invention will become apparent as the discription proceeds, especially when taken in conjunction with the accompanying drawings illustrating the invention.

BRIEF DESCRIPTION OF THE DRAWINGS PLUS REFERENCES

Figure 7:
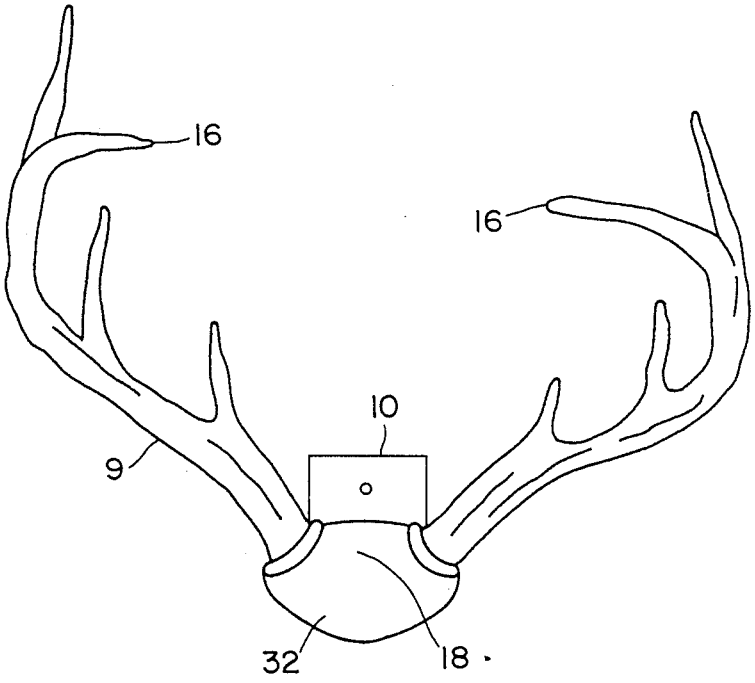
Figure 8:
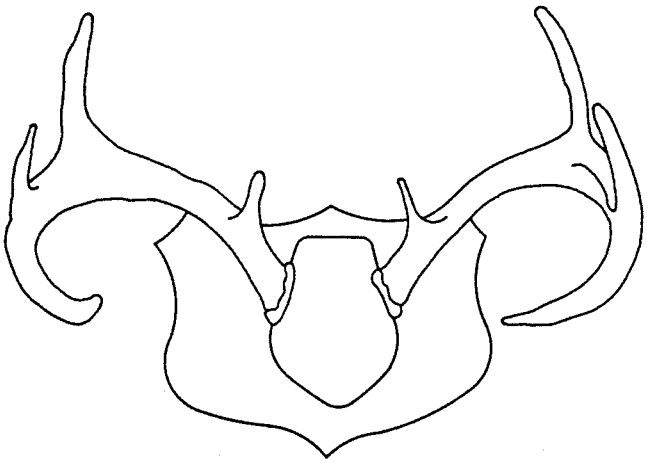
FIG. 8 PRIOR ART

FIG. 7 is a Front View of a completed mount on the Adjustable Antler Hanger Bracket. The top of the skull is at the same angle as if the deer was staring straight out at you, thus the antler rack is displayed in it's most natural position, thus showing all the beauty, symmetry and characteristics of the antler rack. My invention doesn't require a fancy backboard or wall plaque, after all it is the antlers that you are proud of displaying;

FIG. 8 identifies the Prior Art. The bone structure forming the bridge between the antlers, regardless of how much remains of it is almost always fastened with it's flat surface perpendicular or almost perpendicular to it's back board or wall upon which it is hung, thus making the main beams of the antler rack point a bit downward as if the deer was looking down a short distance in front of him and not really showing all the beauty, semmetry and characteristics of the antler rack.

Reference Numeral

No. 9 is a completed mount.
No. 10 is the Back Wall Plate.
No. 12 is the Base Plate.
No. 14 is the Double Adjustable Plate.
No. 16 is the antler rack.
No. 18 is the top of the skull.
No. 20 are two 3/16 inch diameter by ⅝ inch long bolts.
No. 21 are two nuts for 3/16 inch diameter bolts.
No. 22 are two 3/16 inch diameter by 2 inches long bolts.
No. 23 are two nuts for 3/16 inch diameter bolt.
No. 24 is a 4½ inches long slot 3/16 inch wide located in the center of the Base Plate and the center of the Double Adjustable Plate, begining 1 inch from the back and running from back to front.
No. 26 are two ⅜ inch holes for hanging temporarily.
No. 28 are two ⅛ inch holes for hanging permanently.
No. 30 is the front 3/16 inch diameter hole in the Base Plate 12 for inserting one bolt 20.
No. 32 is the front of the skull.

Figure 1:
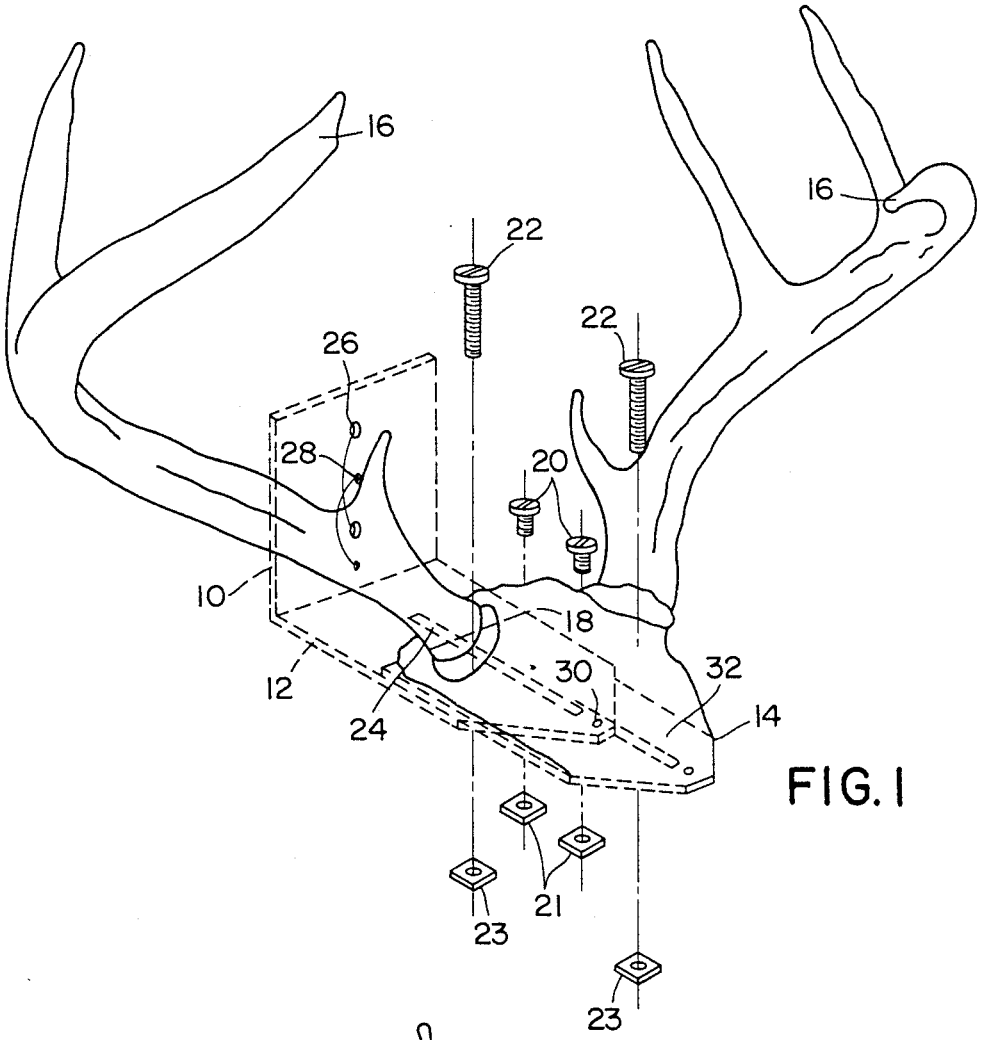
FIG. 1 is an Isometric View of antler on Hanger Bracket with Adjustable Plate.
Figure 2:
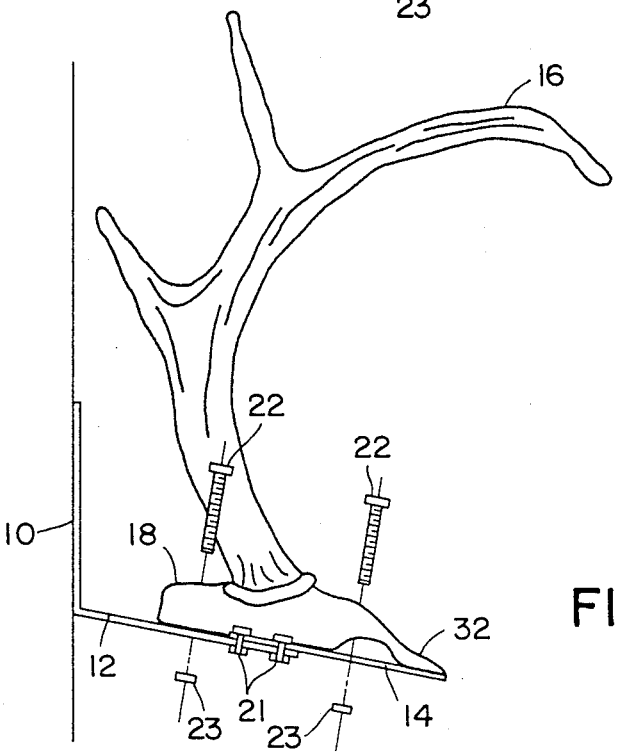
FIG. 2 is a Side View of antlers on Hanger Bracket with Adjustable plate.
Figure 3:
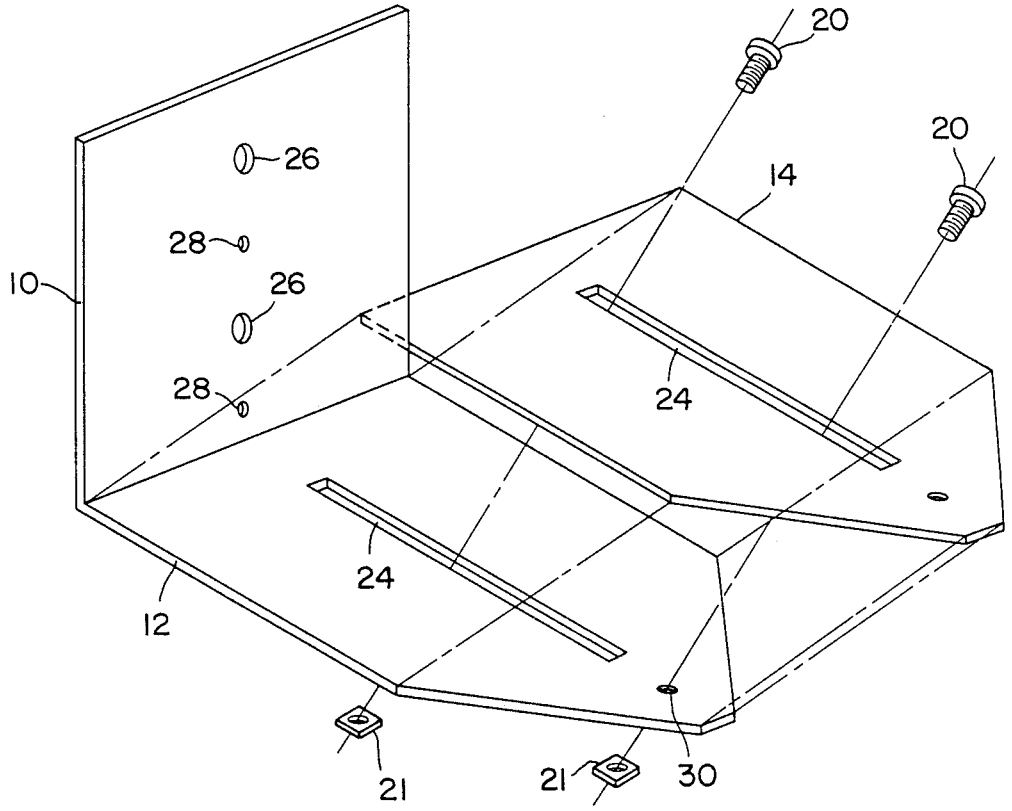
FIG. 3 is an Isometric View of the Hanger Bracket with Adjustable Plate.
Figure 4:
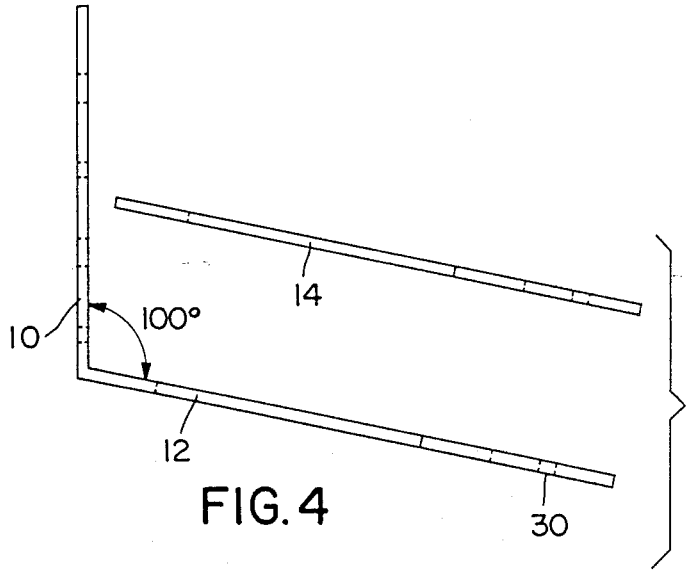
FIG. 4 is a Side View of the Hanger Bracket with Adjustable Plate.
Figure 5:
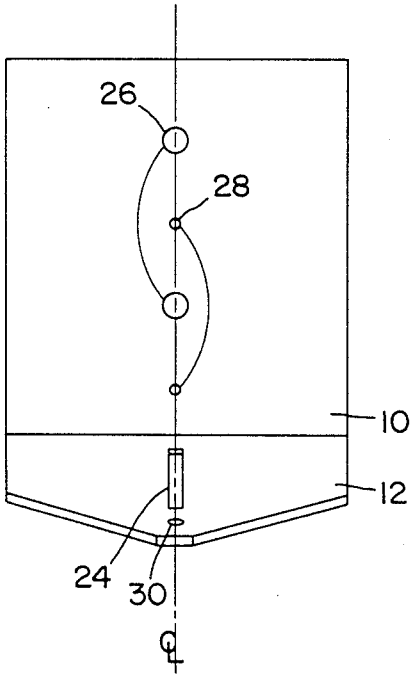
FIG. 5 is a Front View of the Hanger Bracket without the Adjustable Plate.
Figure 6:
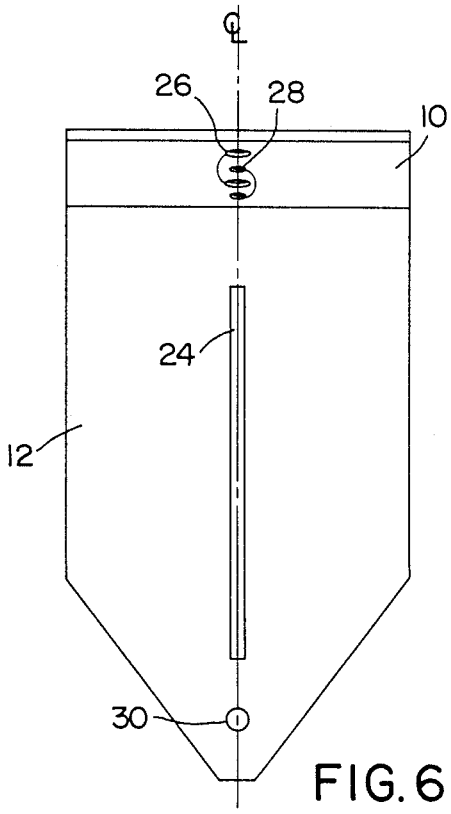
FIG. 6 is a Top View of the Hanger Bracket without the Adjustable Plate.

FIGS. 1, 2, 7 and No. 9 illustrate a finished trophy mount 9 and also the steps of making the trophy mount 9 and how the adjustment mechanism of my bracket works according to the invention.

FIGS. 1 and 2 illustrates a Back Wall Plate 10 which has two different sets of holes, two for temporary hanging 26 and two for permanent hanging 28. A Base Plate 12 which is at 100° degree downward angle to the Back Plate 10 this Base Plate 12 has a Double Adjustable Plate 14 which is the same size and shape as the Base Plate 12 they both have a slot 24 running in the center from 1 inch from the back of the Plates 12 and 14 to 1½ inches from the front of these same Plates 12 and 14. These Plates 12 and 14 also have a hole 30 half way from where the slot 24 ends and the front edge of the Plates. These slots 24 and holes 30 are for inserting Bolts 20 complete with nuts 21 to fasten both Plate 12 and 14 together at the position desired. The slots 24 are also for insertion of the two bolts 22 to fasten the top of the skull 18 to the Double Adjustable Plate 14.

The mount is made first by removing the scalp off the skull 18 and 32 with antlers 16 intacted of an adult male deer by making a cut approximately 2 inches lower than the top of the skull 18 to approximately 1 inch lower than the front of the skull 32 all around the deer's skull 18 and 32, now two more cuts can be made directly in back of the base of the antlers 16 now just peel this scalp of the skull 18 and 32 and freeze, wrapped in a plastic bag for future use. Now with the skull bone 18 and 32 exposed, a cut should be made through the upper third of the eye socket in the front of the skull 32, too 1¼ inch thick in the back of the top of the skull 18, this should remove the trophy antlers 16 with skull 18×32 intacted. Whatever flesh or meat that still remains on the skull 18 and 32 should be cut and scraped off till the skull 18 and 32 are clean and should be hung too air dry for a few days. After the skull 18 and 32 with antlers 16 intacted has dried after a few days one can proceed to finish the mount 9. First tip the skull 18 and 32 upside down in order to drill the two holes for bolts 22 complete with nuts 23. The way that the inside of the top of the skull 18 of a deer is formed there is a small channel like depression directly in the center of the top of the skull 18 that runs the whole length of the inside of the top of the skull 18. One has to simply insert 3/16 inch diameter drill into this depression and drill two holes approximately 2 inches apart and he can be assured that he is directly in the center of the top of the skull 18 so that when the said skull 18 and 32 with antlers intacted is fasten on top of the Adjustable Double Plate 14 with bolts 23 complete with nuts 22 through the slots 24, the skull 18 and 32 will be perfectly centered on the Bracket and not all to one side. Now that the skull 18 and 32 with antlers 16 intacted has been cut at the correct angle and the holes for bolts 22 have been drilled it is time to adjust the Adjustable Double Plate 14 for this particular set of antlers 16.

As the antlers 16 of a deer don't grow out of the skull vertically especially the main beams which form the structure of the antler rack 16 tend to grow curved or swept backwards towards the back of the deer's head, mostly going beyond, past the back of the top of the skull 18 and just how much the antlers 16 sweep backwards varies from deer to deer. This is where the Double Adjustable Plate 14 comes in quite handy. One simply loosens the back bolt 20 complete with nut 21 and removes the front bolt 20 completely from the plates. Now that the Double Adjustable Plate 14 is loose enough to be slipped forward, just hang the bracket on a wall on a hook or screw through one of the holes 26 in the Back Wall Plate 10 made for temporary hanging. Now just rest the cut underside of the skull 18 and 32 with antlers 16 intacted on top of the Double Adjustable Plate 14. Now slide the Double Adjustable Plate 14 forwards until the front of the skull 32 is flush with the edge of the Double Adjustable Plate 14 or extending out no more then 1 inch past the front edge of the said Double Adjustable Plate 14 and that the back of the antlers 16 are just far enough that they are not touching neither the wall nor the Back Wall Plate 10, now tighten the one remaining bolt 20 complete with nut 21 as far back in the slot 24 of the Double Adjustable Plate 14 as it can go but leaving the Double Adjustable Plate 14 exactly where it has been positioned for this particular set of deer antlers 16. Now remove from the wall the Adjustable Bracket and lay aside the skull 18 and 32 with antlers 16 intacted and insert the second bolt 20 complete with nut 21 through the slot 24 of the Double Adjustable Plate 14 and through the hole 30 in the Base Plate 12 and tighten securely. Now the Adjustable Hanger Bracket is adjusted to accommodate this particular set of deer antlers 16.

The skull section 18 and 32 can be covered with any suitable material and only needs to be sewn together underneath the cut side of the skull 18 and 32 but first the 2 bolts 22 have to be installed through predrilled holes in the top of the skull 18. Now after the material or the scalp itself has been attached to the skull 18 and 23 just lay the skull 18 and 32 with antlers 16 intacted with the cut side down on top of the Double Adjustable Plate 14 and tightened the nuts 23 to the end of bolts 22 protruding through the underside of the Base Plates 12 and 14 making sure the skull 18 and 32 with the antlers intact are in the same predetermined position assuring that the front of the skull 32 is not extending more than 1 inch past the front edge of the Adjustable Double Plate 14 and that the back of the antlers 16 are not protruding too far back as to not be touching the wall nor the Back Wall Plate 10. When the bolts 22 complete with nuts 23 are tightened to fasten the skull 18 and 32 to the top of the Double Adjustable Plate 14 it also seals the edges of the cut side of the undersides of the skull 18 and 32 to the top of the Double Adjustable Plate 14 it makes a neat looking job with whatever sewing that was done is now hidden underneath the skull 18 and 32 bone. The skull 18 and 32 can also be painted a shade of brown to simulate the color of a deer's scalp.

Now that skull 18 and 32 has been cut at the correct angle and installed on the Adjustable Antler Hanger Bracket at the right predetermined position the top of the skull 18 should be 90° degree to the Back Wall Plate 10 and the said top of the skull 18 will be in, as I emphasized before, at the same angle as if the deer was alert and staring straight out in front of him, thus showing the antlers 16 as they were in their most natural position thus showing all the beauty, semmetry and characteristics of the antlers 16. With all the steps completed the mount 9, FIG. 7 is now ready to be hung on a wall either permanently with one ⅛ inch diameter screw through either of the holes 28 in the Back Wall Plate 10 or hung upon a screw or hook on the wall through one of the holes 26 in the Back Wall Plate 10.

While I have illustrated and described a prefered embodiment or finish mount of my invention, it is understood that this is capable of modification and I therefore do not wish to be limited to the precise details set forth, but desire to avail myself of such changes and alterations as fall within the purview of the following claims. For instance the invention may be used to mount most any size and shape of deer antlers. It can be made of any suitable material preferably aluminum.

What I claim as my invention is:

1. A trophy mount for displaying deer antlers in their most natural position as if the deer was elert and staring straight out in front of him comprising:

(a) a complete top of the skull of an adult male deer with the antlers intacted, cut through the upper third of the eye socket in the front of the skull to 1¼ inch thick in the back of the top of the skull;

(b) an antler hanger bracket comprising a back wall plate adapted to be hung upon a wall, including a base plate portion extending from said back wall plate portion at 100° degree downward angle, with said base plate portion having holes and an elongated slot therein, plus a double adjustable plate overlying the said base plate and also having holes and an elongated slot, said base plate and said double adjustable plate being fastened together in an adjustable manner via bolts extending through said holes and elongated slots.

2. A bracket as defined in claim one upon which the properly cut top of the skull of an adult male deer with antlers intacted, is fastened with it's cut side resting upon the top of the double adjustable plate by use of bolts and nuts through drilled holes in the center top of the skull and through an elongated slot in the said plate.

* * * * *